United States Patent [19]

Tauber

[11] 4,364,461

[45] Dec. 21, 1982

[54] PARKING INDICATOR TOKEN STRIP

[76] Inventor: George Tauber, Kandlgasse 37, Vienna, Austria, A-1071

[21] Appl. No.: 192,840

[22] Filed: Oct. 1, 1980

[30] Foreign Application Priority Data

Mar. 21, 1980 [CH] Switzerland ..... 2248/80

[51] Int. Cl.[3] ..... G07F 7/02

[52] U.S. Cl. ..... 194/4 D

[58] Field of Search ..... 194/4 R, 4 C, 4 D, DIG. 22, 194/4 E, 4 B

[56] References Cited

U.S. PATENT DOCUMENTS 2,594,388 4/1952 Broussard ..... 194/DIG. 22

3,087,018 4/1963 Pferd ..... 194/4 E 3,338,365 8/1967 Hoffberger et al. ..... 194/4 R

*Primary Examiner*—Stanley H. Tollberg

*Attorney, Agent, or Firm*—Wenderoth, Lind & Ponack

[57] ABSTRACT

A parking indicator for motor vehicles comprises a channel for the insertion of a value strip and time indicators which are not adjustable when the value strip has been inserted into the channel. In order to prevent the value strip from being withdrawn from the channel without being damaged, the value strip is provided with teeth mating with a toothed wheel arranged in the channel, the toothed wheel being rotatable only in the direction of insertion of the value strip, thus forming locking structure retaining the value strip.

24 Claims, 7 Drawing Figures

PARKING INDICATOR TOKEN STRIP

BACKGROUND OF THE INVENTION

The present invention relates to a value strip for use in a parking indicator for motor vehicles or the like, the parking indicator comprising a channel for inserting the value strip, locking means for retaining the strip in the channel and time indicators which are not adjustable when the value strip has been inserted into the channel, the value strip preferably having a projection wider than the channel.

A parking indicator of the above-mentioned kind has already been described in U.S. Pat. No. 3,998,307. This indicator serves for levying a parking fee for motor vehicles, such free corresponding to the length of time the vehicle is parked. For the payment of the parking fee, a value strip is inserted into the parking indicator, when the permitted time of parking has been set. In order to ensure that the payment of such fee is not evaded, i.e. that the time of parking is not extended unlawfully, the parking indicator is designed in such a manner that the value strip can be inserted into the channel of the device without being damaged and therein prevents any adjustment of the time indicators. The value strip is devaluated, preferably by being torn, only when it is withdrawn from the channel. The fact that the value strip can be inserted into the channel of the parking indicator without being damaged implies that the value strip is certainly devaluated when being withdrawn, i.e. that it is impossible to withdraw the value strip without damaging it. To this end, this prior art parking indicator is provided with a detent arranged in the channel, the detent corresponding to a recess in the value strip and extending into such recess when the value strip is in the pushed-in position. When the value strip is withdrawn from the channel, it must, consequently, be torn in the region of the detent, i.e. of its recess. It seems possible, however, that a thin metal strip, for example, may be inserted into the channel below the value strip, thus pushing down the detent, and that the value strip may be withdrawn from the channel without being damaged.

SUMMARY OF THE INVENTION

It is, therefore, the object of the present invention to eliminate this disadvantage and to improve a value strip and a parking indicator for motor vehicles in that unlawful manipulating in order to extend the time of parking, i.e. to evade the payment of the parking fee, is eliminated to the greatest possible extent.

In accordance with the present invention this is achieved by providing the value strip for use in the parking indicator for motor vehicles with a toothed portion corresponding with locking means.

The toothed portion preferably is formed by recesses arranged on an edge of the value strip extending in the direction of insertion so that the locking means arranged in the channel of the parking indicator can be provided with at least one toothed wheel mating with the toothed portion of the value strip and being rotatable only in the direction of insertion of the value strip.

This embodiment ensures that the value strip cannot be withdrawn from the channel without being damaged when manipulating the parking indicator.

The value strip preferably is designed in such a manner that indents are arranged at the bottom of the recesses, such indents being adjacent to a number of the teeth of the toothed portion and being directed towards the forward end of the value strip. This ensures that the teeth of the value strip are torn off and that the devaluation of the value strip is easily controllable when it has been withdrawn in the prohibited direction.

It further preferably is provided that the value strip has weak points, e.g. a perforation, extending in the direction of insertion. Hence, the channel of the parking indicator, at the end thereof opposite to the end for inserting the value strip, can be divided into two portions diverging in opposite directions from the plane of the value strip to ensure that the value strip is torn through and valueless when being pulled through the channel.

An unlawful repair of the value strip by gluing the torn portions can be avoided by covering the weak points with a colored layer which is in contrast with the color of the value strip. When the value strip is torn through along the weak points, this colored layer exhibits visibly damaged torn fibers.

It further preferably is provided that the value strip is L-shaped in a conventional manner, the dimension of the longer leg of the L substantially corresponding to the space of the channel and time indicating symbols being provided on the shorter leg, such symbols being delimited by weak points where they can be torn through. Hence, the pre-set time of parking is first marked on the parking indicator and second on the value strip.

BRIEF DESCRIPTION OF THE DRAWING

In the following the invention will be described in greater detail with reference to the accompanying without being limited thereto, and wherein.

DETAILED DESCRIPTION OF THE INVENTION

Figure 1:
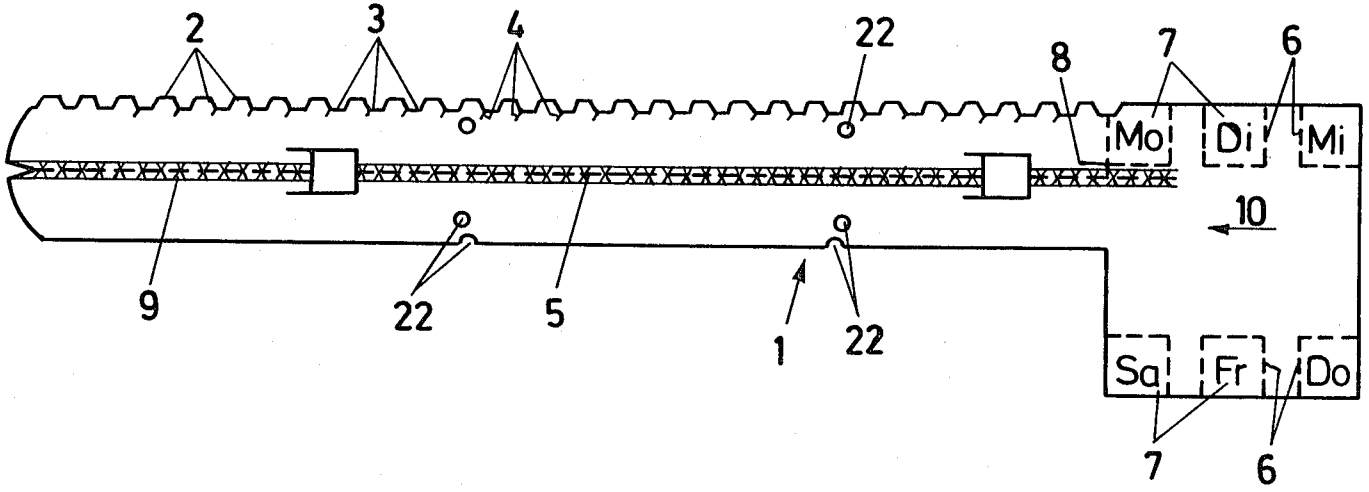
FIG. 1 is a top view of an undamaged value strip.
Figure 2:
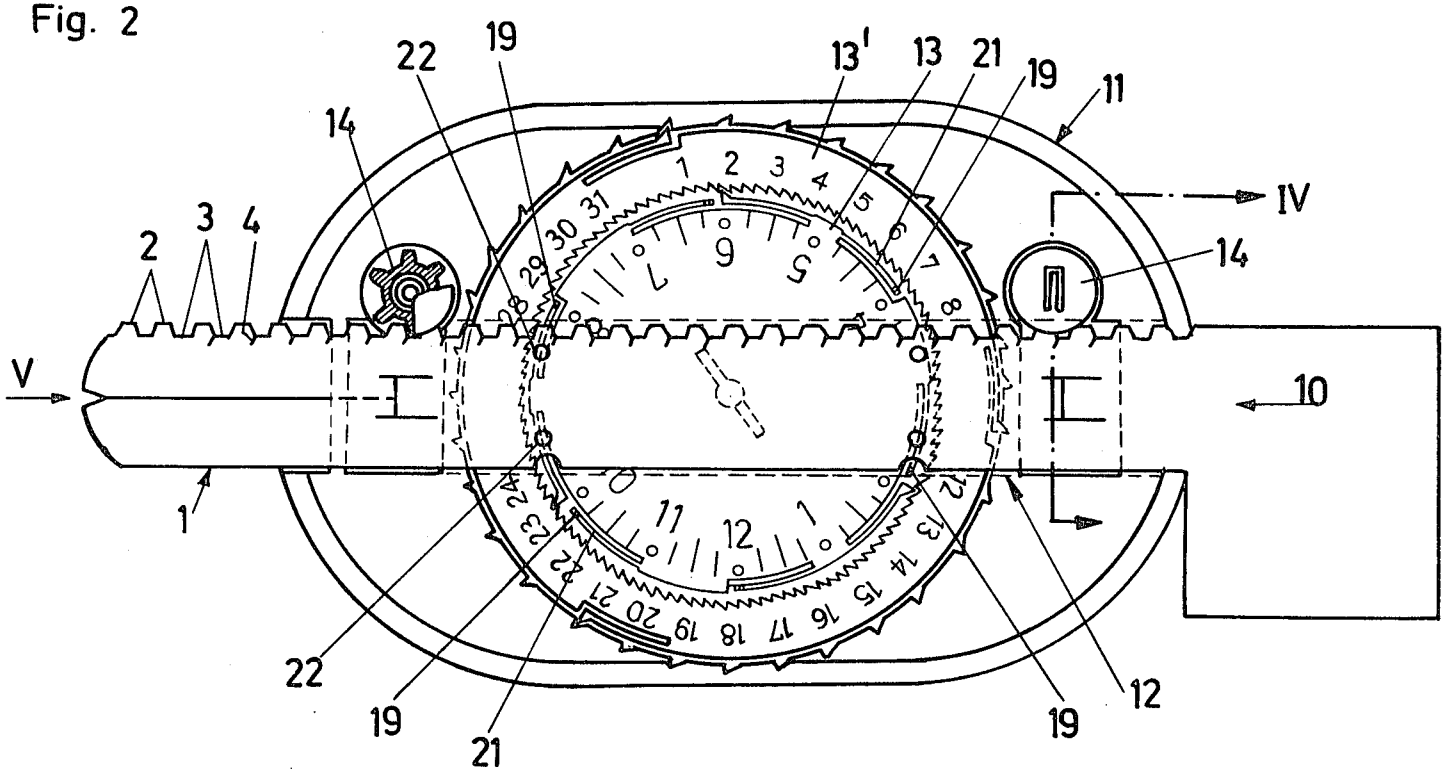
FIG. 2 is a schematic top view, partially in section, of the value strip inserted in a parking indicator.
Figure 3:
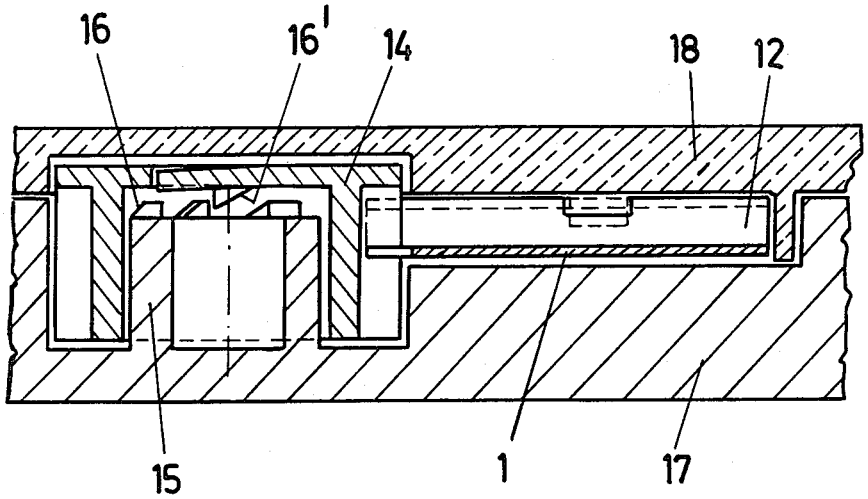
FIG. 3 is a sectional view along plane IV—IV of FIG. 2.

The value strip illustrated in FIG. 1 adapted to be used in a parking indicator for motor vehicles or for similar purposes is L-shaped, the dimensions of the longer leg substantially corresponding to the space of a channel arranged in the indicating device, the dimensions of the shorter leg of the value strip 1 being greater than the inside width of the channel. Value strip 1 is insertable into the channel of the parking indicator in the direction of arrow 10 and is provided with a toothed portion along an edge or rim extending in the direction of insertion, such toothed portion being formed by recesses 3 and teeth 2. Indents or reduced thickness portions 4 arranged at the bottoms of recesses extend from a number of teeth 2 towards the forward end of value strip 1. Value strip 1 further has a perforation 5 extending in the direction of insertion. Perforation 5 is covered by a layer 9 of a color in contrast with the color of the value strip 1. A perforation 8 is further provided between the shorter leg and the longer leg of the L-shaped value strip 1 so that the two legs can be torn through. Time indicating symbols 7 delimited by further perforations 6 are detachably arranged on the shorter leg. The toothed portion of the value strip 1 formed by recesses 3 and teeth 2 should, when the value strip is inserted into the channel of a parking indicator, correspond with locking means arranged in the channel, thus ensuring that the value strip cannot be withdrawn against the direction of insertion without being damaged. FIG. 2 is a schematic view of the parking indicator 11, the value strip 1 being duly inserted therein. The parking indicator 11 receives the value strip 1 in a channel 12 and further comprises two concentrically arranged discs 13 and 13' provided with time indicating symbols adapted to delimit or fix the permitted time of parking. The permitted time of parking is set by the position of the time indicating symbols with respect to reference marks, which have not been illustrated. For the adjustment of the time indicating symbols with respect to the reference marks, the inner disc 13 is provided with a slot similar to a screw driver so that disc 13 can be turned by means of a coin, for example. Upon counter clockwise rotation, the inner disc 13 drives the outer disc 13'. Upon clockwise rotation only the inner disc 13 is moved. The slot, which substantially has the shape of a screw slot, is arranged below the channel and, hence, below the duly inserted value strip so that a rotation of the two discs is impossible when the parking indicator is in the operative condition. The locking means corresponding to the toothed portion of the value strip 1 comprise two toothed wheels 14 arranged on opposite longitudinal sides of discs 13 and 1', wheels 14 being rotatable only in the direction of insertion 10. As can be seen in the sectional view illustrated in FIG. 3, each toothed wheel 14 is rotatably mounted on a pin 15, whereby sawtooth projections 16 and 16' are arranged on pin 15 and on toothed wheel 14, respectively, projections 16 and 16' engaging one another. The saw-tooth projections 16' arranged on the toothed wheel 14 are resilient so that a clockwise rotation of the toothed wheels will be possible. A counterclockwise rotation of the toothed wheels will be impossible, however.

Figure 4:
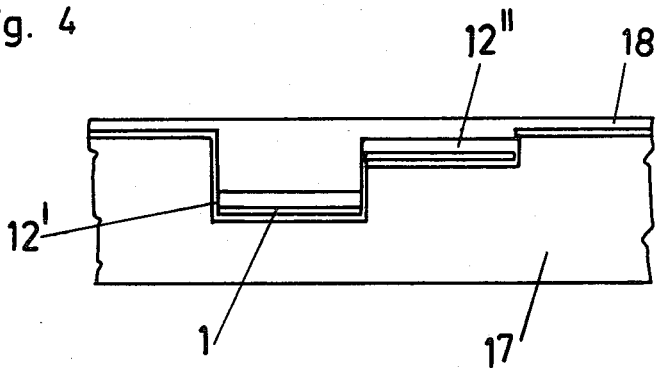
FIG. 4 is a front view of the channel of the parking indicator at the side opposite the side of insertion of the value strip.

As can be seen, the toothed wheels permit an insertion of the value strip 1 in the direction of the arrow 10. They ensure, however, that the value strip cannot be withdrawn without destruction thereof. For the purpose of withdrawal, the value strip has to be torn through at the perforation 8 illustrated in FIG. 1, thus effecting a visible destruction and devaluation thereof. When the two legs of the value strip 1 have been torn through, the leg which is in the channel 12 is withdrawn from the channel in the direction of the arrow, and thereby is torn through along its perforation 5. As illustrated in FIG. 4, this is due to the fact that at the end of the channel opposite the side of insertion of the value strip 1 the channel 12 is divided into two portions 12' and 12'' diverging in the opposite directions from the plane of the value strip 1.

Figure 5:
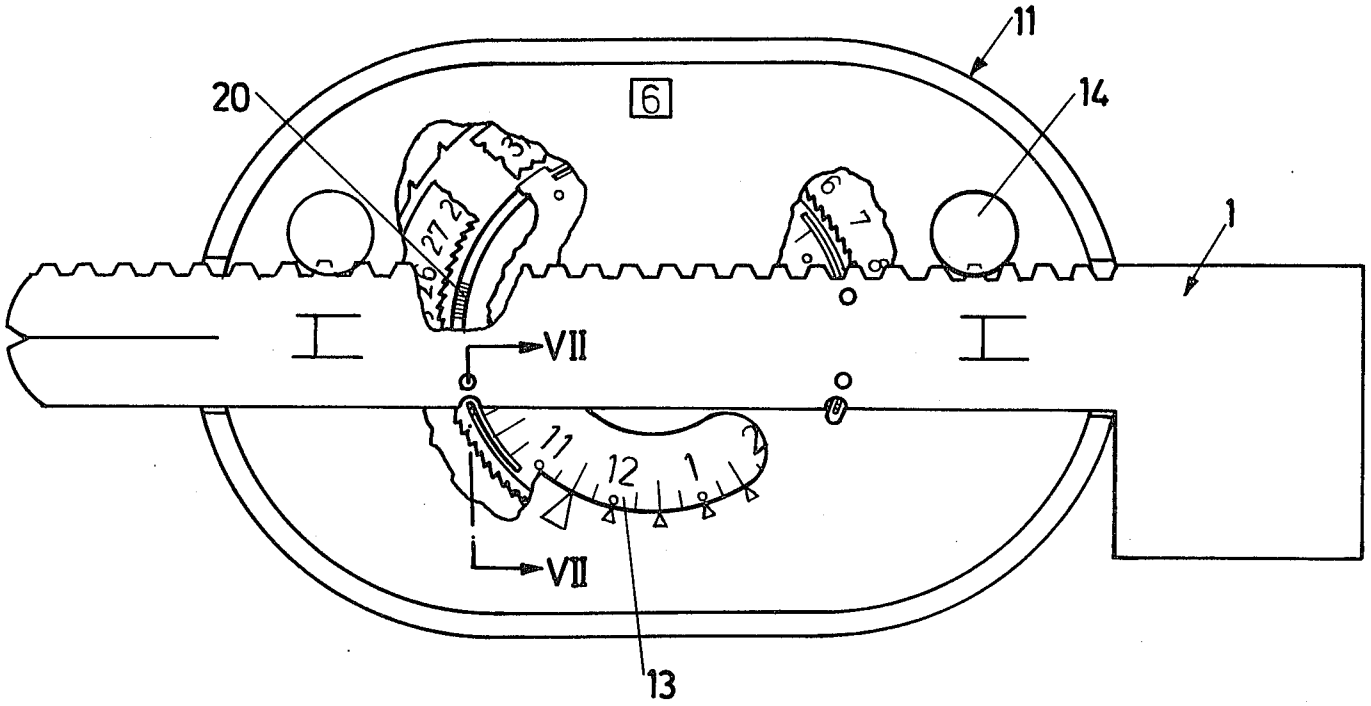
FIG. 5 is a top view of the parking indicator, with component parts cut away, the value strip being in the pushed-in position.
Figure 6:
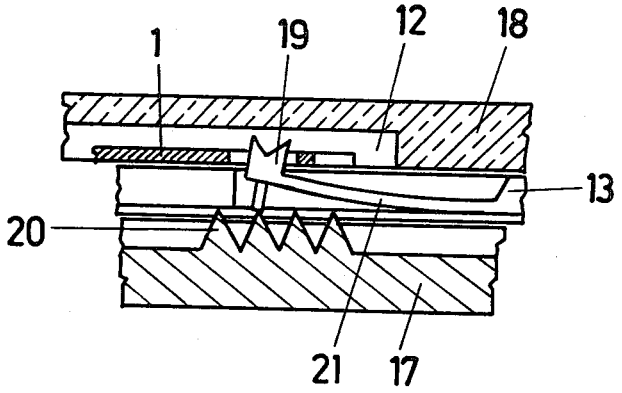
FIGS. 6 and 7 are sectional views along plane VII—VII of FIG. 5 showing differential functional conditions.
Figure 7:
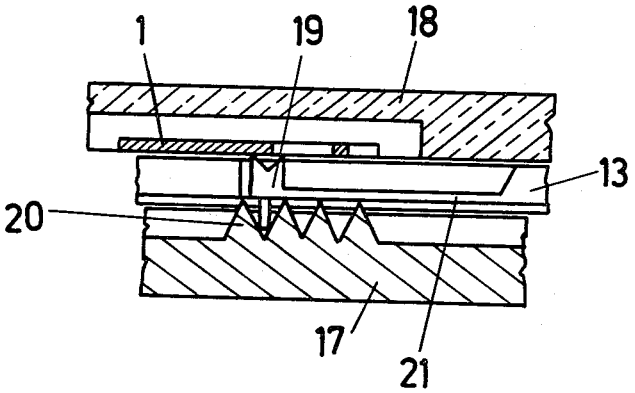

In order to ensure that the two discs 13 and 13' are not rotated when the value strip 1 has been inserted, the value strip 1 runs in the channel 12 adjacent to the rotatably mounted disc 13. Tongues 21 are provided on the disc 13 extending in the circumferential direction of the disc. Locking cams 19 are arranged on the ends of the tongues. Cam 19 correspond with actuating cams 20 in a baseplate 17 of the parking indicator, as illustrated in FIGS. 5, 6 and 7. A rotation of the disc 13 effects that the locking cams 19 move over the actuating cams 20 in the baseplate 17, thus entering into the inside space of the channel 12. Hence, when a value strip has been inserted into the channel 12, either the strip is torn through by the locking cams 19 or a rotational movement of disc 13 is prevented. Such rotational movement of the disc 13 is further prevented by providing the value strip 1 with recesses 22 in which the locking cams 19 engage when cams 19 are pressed into the space of channel 12 by the actuating cams 20. This ensures that an unlawful rotation of the discs 13, 13' is impossible when the value strip is in the pushed-in position. The parking indicator is fully covered by a cover plate 18 which has only a recess in the region of the slot of the inner disc 13.

What is claimed is:

1. A value strip for use in a parking indicator of the type including a casing, means for indicating the time of commencement of parking and operably connected to and movable with respect to the casing, a channel through the casing for insertion therethrough of the value strip to prevent adjustment of the time indicating means, and locking means for retaining the value strip in the channel, said value strip comprising:

an elongated flat member having formed along one longitudinal edge tooth means for meshing engagement with the locking means of a parking indicator, said member having a weakening means for causing visible destruction of said member to occur when removal of said member from the channel in the parking indicator, in the direction of insertion into the channel or in a direction opposite to the direction of insertion is attempted.

2. A value strip as claimed in claim 1, wherein said tooth means comprises teeth formed by recesses in said edge of said member.

3. A value strip as claimed in claim 2, further comprising reduced thickness areas extending from bottoms of said recesses adjacent at least some of said teeth toward the forward end of said member, taken in the direction of insertion.

4. A value strip as claimed in claim 1, further comprising a weakened area extending longitudinally throughout the majority of the length of said member.

5. A value strip as claimed in claim 1, wherein said member includes an integral laterally extending projection having a width wider than the channel.

6. A value strip as claimed in claim 5, further comprising a weakened area between said projection and the remainder of said member.

7. A value strip as claimed in claim 1, wherein said member is substantially L-shaped including a longer leg extending in the direction of insertion and having dimensions substantially equal to the channel and a shorter leg formed integrally with said longer leg and extending transversely of the direction of insertion by a dimension greater than the width of the channel.

8. A value strip as claimed in claim 7, wherein said shorter leg includes detachable time indicating portions defined by weakened areas.

9. A value strip as claimed in claim 7, further comprising a weakened area between said longer and shorter legs.

10. A value strip as claimed in claims 4, 6, 8 or 9, further comprising a colored layer covering said weakened area, said colored layer being of a color contrasting with the color of said member.

11. A parking indicator comprising:

a casing;

means for indicating the time of commencement of parking, said time indicating means being operably connected to and movable with respect to said casing;

said casing having therein a channel;

a value strip insertable into said channel to an operative position whereat said time indicating means is prevented from being further adjusted;

said value strip having along a longitudinal edge thereof a toothed portion; and toothed wheel means, mounted on said casing and in meshing engagement with said toothed portion of said value strip, for allowing insertion of said value strip into said channel and preventing withdrawal of said value strip from said channel.

12. A parking indicator as claimed in claim 11, wherein said toothed wheel means comprises at least one toothed wheel rotatably mounted on a pin of said casing, said toothed wheel and said pin each having saw-tooth projections enabling rotation of said toothed wheel about said pin in a first direction enabling insertion of said value strip, said saw-tooth projections engaging each other and preventing rotation of said toothed wheel with respect to said pin in a second direction opposite to said first direction.

13. A parking indicator as claimed in claim 11, wherein said time indicating means comprises at least one disc mounted for rotation within said casing, said channel extending adjacent said disc, said disc being provided with locking cams movable toward said value strip, said casing including a base plate having actuating cams moving said locking cams into the volume of said channel upon rotation of said disc.

14. A parking indicator as claimed in claim 13, wherein said time indicating means includes circumferentially extending tongues, said locking cams being provided on said tongues.

15. A parking indicator as claimed in claim 11, wherein one end of said channel is laterally divided into two portions diverging in opposite directions.

16. A parking indicator as claimed in claim 11, wherein said toothed portion of said value strip comprises teeth formed by recesses in said edge of said value strip.

17. A parking indicator as claimed in claim 16, further comprising reduced thickness areas extending from bottoms of said recesses adjacent at least some of said teeth toward the forward end of said value strip, taken in the direction of insertion.

18. A parking indicator as claimed in claim 11, further comprising a weakened area extending longitudinally throughout the majority of the length of said value strip.

19. A parking indicator as claimed in claim 11, wherein said value strip includes an integral laterally extending projection having a width wider than said channel.

20. A parking indicator as claimed in claim 19, further comprising a weakened area between said projection and the remainder of said value strip.

21. A parking indicator as claimed in claim 11, wherein said value strip is substantially L-shaped including a longer leg extending in the direction of insertion and having dimensions substantially equal to said channel and a shorter leg formed integrally with said longer leg and extending transversely of the direction of insertion by a dimension greater than the width of said channel.

22. A parking indicator as claimed in claim 21, wherein said shorter leg includes detachable time indicating portions defined by weakened areas.

23. A parking indicator as claimed in claim 21, further comprising a weakened area between said longer and shorter legs.

24. A parking indicator as claimed in claims 18, 20, 22 or 23, further comprising a colored layer covering said weakened area, said colored layer being of a color contrasting with the color of said value strip.

* * * * *